US005101757A

United States Patent [19]

Schumacher

[11] Patent Number: 5,101,757

[45] Date of Patent: Apr. 7, 1992

[54] GLUE CELLS APPARATUS FOR APPLYING GLUE IN A WEB PRINTING UNIT

[75] Inventor: Thomas H. Schumacher, Downers Grove, Ill.

[73] Assignee: WPC Machinery Corporation, Downers Grove, Ill.

[21] Appl. No.: 486,016

[22] Filed: Feb. 28, 1990

[51] Int. Cl.[5] ..... B05C 1/08

[52] U.S. Cl. ..... 118/46; 118/69; 118/202; 118/249; 118/262

[58] Field of Search ..... 118/46, 202, 249, 262, 118/69; 101/219

[56] References Cited

U.S. PATENT DOCUMENTS

| | | | |
|---|---|---|---|
| 890,221 | 6/1908 | Davidson et al. | 118/261 |
| 1,308,114 | 7/1919 | Roesen | 101/364 |
| 2,333,172 | 11/1943 | Grupe | 101/157 |
| 2,631,532 | 3/1953 | Harless | 101/364 |
| 2,641,220 | 6/1953 | Weber et al. | 118/259 |
| 3,026,842 | 3/1962 | Faeber | 118/261 |
| 3,111,897 | 11/1963 | Van Buskirk | 101/350 |
| 4,372,244 | 2/1983 | Rebel | 118/46 |
| 4,452,172 | 6/1984 | Dyett et al. | 118/203 |
| 4,848,265 | 7/1989 | Komori | 118/46 |
| 4,934,305 | 6/1990 | Koehler et al. | 118/46 |

*Primary Examiner*—Michael G. Wityshyn
*Attorney, Agent, or Firm*—Welsh & Katz, Ltd.

[57] ABSTRACT

A glue cell apparatus for applying glue in a web printing unit is disclosed, which apparatus includes one or more self-contained modular units that have a finite width in the direction of the width of the web to which glue is applied. The modular units are carried and mounted upon a rail structure that extends substantially across the full width of the web and a drive shaft is also provided which also extends substantially the same distance. Each of the glue cells preferably has a transfer cylinder that is driven by the drive shaft that is operably connected and driven by the gluing and/or coating machine, and a metering roller subassembly having a metering roller which calibrates the thickness of the layer of glue that is ultimately applied to the web. The metering roller has an internal hydraulic motor which drives the same. In an alternate embodiment, a pan roller subassembly is also provided.

42 Claims, 3 Drawing Sheets

GLUE CELLS APPARATUS FOR APPLYING GLUE IN A WEB PRINTING UNIT

The present invention generally relates to web printing apparatus, and more particularly relates to an apparatus which may include one or more modular units, which are appropriately referred to as glue cells, for applying glue to a generally continuous web as it moves through a printing operation.

Quite often, a web printing job will involve not only the printing of a generally continuous web of paper by running the web through a multi-color printing press, but will also require gluing, perforating, folding and the like. There are different types of gluing apparatus known to those of ordinary skill in the art, including wet-flap gluers, and pattern gluers having conventional or segmented glue trains. Segmented gluers are gluing apparatus which generally apply glue in selected portions along the width of the web as it passes through a gluing station. In the prior art, such apparatus typically included a relatively small diameter shaft that extended across the full width of the web, suitably rotatably journaled in side frames, to which larger diameter split cylindrical segments, often called "saddles", were attached at the locations along the shaft where glue was to be applied to the web.

It is also well known to those of ordinary skill in the art that the thickness of the glue layer that is applied to a web is often critical and must be controlled within very close tolerances or problems will occur. The desired dry film glue thickness is often within the range of about 4 to 6 ten thousandths of an inch. It is also well known that if the glue thickness is only 2 to 3 ten-thousandths, the adhesive capability may be insufficient, and if it is 7 ten thousandths of an inch or greater, the glue may not dry quickly enough to prevent problems with downstream apparatus such as perforators, folders and the like.

A common problem with many prior art segmented gluers of the type which have a common arbor or shaft to which the saddles are attached is deflection of the shaft. As should be readily appreciated, any deflection of the shaft will result in variation of the distance between the outer surface of the saddles relative to the pan roller and plate cylinder, the latter of which receives the glue and transfers it to the web itself. Such variation of the distance will result in variation of the thickness of the layer of glue applied, which will also result in the attendant problems just described.

Accordingly, it is a primary object of the present invention to provide an improved gluing apparatus that will efficiently and effectively apply a uniform layer of glue on the web at one or more preselected locations across the width of the web, utilizing one or more independent self-contained glue applying units, or glue cells.

Another object of the present invention is to provide such an improved glue cell which can be easily installed and removed along the width of the web which reduces the amount of down-time that is often experienced due to changeover or repair.

Yet another object of the present invention is to provide such an improved glue cell which includes a metering roller for controlling the thickness of the glue to be applied to the web, wherein the metering roller is driven by a hydraulic motor that is located inside the roller itself and therefore contributes to the compact design. A closely related object lies in the provision of the use of the hydraulic motor, which minimizes the risk of the roller seizing up and creating damage that is often experienced with electric motors.

Still another object of the present invention lies in the provision of providing a separate pan roller in an alternate embodiment, which pan roller applies glue from a pan to a transfer roller before the transfer roller interacts with the metering roller, which pan roller is also driven by an internal hydraulic motor. The use of the pan roller as well as the metering roller not only insures that the precise thickness of the glue applied to the web, but enables the unit to function properly and effectively even if the metering roller is removed for repairs or the like, thereby eliminating down-time of the printing unit in such event.

Another object of the present invention is to provide an improved glue cell which has a mounting assembly that comprises a cooperative mount and track system that permits accurate but variable positioning across the width of the web, so that the individual glue cells may be moved to the desired positions, as well as be easily removed and/or installed. Another closely related object lies in the provision of a common drive shaft that extends across the width of the web and a drive belt assembly that can also be easily positioned so that the transfer cylinder of the glue cell can be driven by the drive train of the printing unit with which the glue cell functions.

Yet another object of the present invention lies in the modular construction of the individual glue cells, and the use of quick connect fittings and flexible conduits or lines for connection to the hydraulic motors thereof, and to a source of cooling fluid which is connected to the transfer cylinder for cooling the same, as well as the provision of connecting the glue cells to a supply of glue and the capability of recirculating the glue. Such easy connection and disconnection of all of these conduits and lines facilitates easy installation and/or removal of individual glue cells vis-a-vis the printing unit with which they are associated.

Another object of the present invention lies in the provision of an improved compact design that utilizes internal motors for self driven roller subassemblies and an internal drive pulley mechanism for driving the transfer cylinder, the internal drive pulley mechanism fitting within the side wall of the apparatus.

These and other objects will become apparent upon reading the following detailed description of the present invention, while referring to the attached drawings, in which.

DETAILED DESCRIPTION

Figure 1:
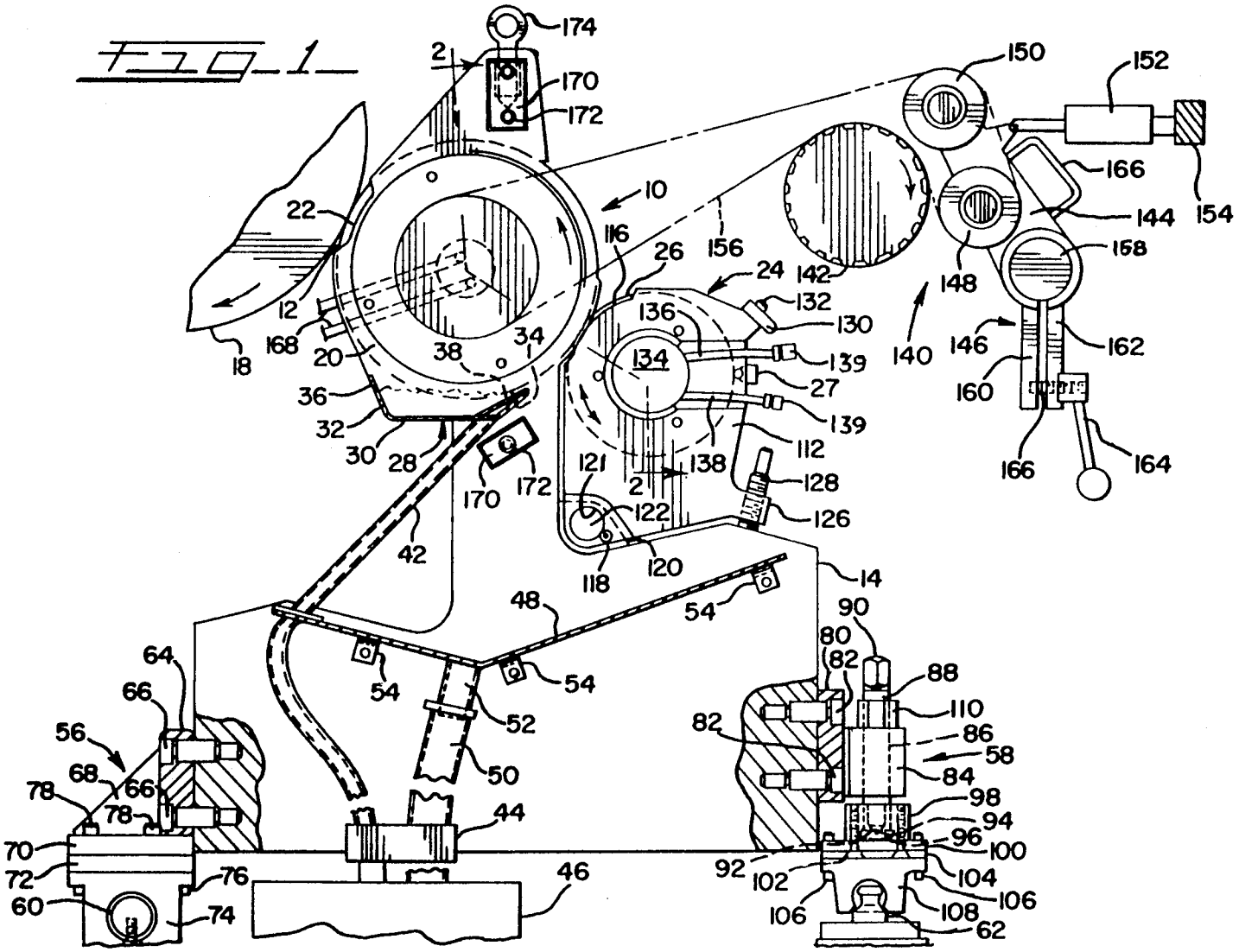
FIG. 1 is a side elevation of a representative glue cell of the preferred embodiment of the present invention.

Broadly stated, the present invention comprises a glue cell apparatus for ultimately applying glue to a continuous web, which is preferably paper, but which can be any other web of material that is susceptible of receiving glue. While the preferred embodiments described herein are for applying glue, it should also be understood that the structure of the present invention is such that fluids other than glue, such as latex scratch off material, gloss coatings, microencapsulated fragrances, cosmetic slurries and the like, could also be applied. However, many of the desireable attributes of the present invention are extremely advantageous in the application of glue during a printing operation, and for that reason the detailed description of the preferred embodiments are described in the context of applying glue.

The glue cells of the present invention comprise self-contained modular units that have a finite width in the direction of the width of the web to which glue is applied, and there may be one or more of such modular units installed across the width of the web, depending upon the printing job that is being performed. Since modern four color printing presses often have a 38 inch web width, it is contemplated that several glue cells, each having an effective width within the range of about four inches to substantially the full width of the web, which may be 38 inches or more. Most common applications will be within the range of about 6 to about 12 inches, with the placement of the glue cells being adjustable depending upon the specific printing job being undertaken.

The modular units are carried and mounted upon a rail structure that extends substantially across the full width of the web and a drive shaft is also provided which also extends substantially the same distance. In this way, one or more glue cells may be installed at selected locations along the width of the web, and will be carried by the rail structure and be driven by the drive shaft. For similar reasons relating to the capability of variably positioning the glue cells, flexible hydraulic lines for powering motors and for passing glue between the glue cells and a supply of glue are provided, and preferably have quick-connect fittings to enable rapid and easy connection and disconnection of the lines.

Each of the glue cells preferably has a transfer cylinder that is driven by the drive shaft that is operably connected and driven by the gluing and/or coating machine, and a metering roll which calibrates the thickness of the layer of glue that is ultimately applied to the web. In the preferred embodiment, the lower portion of the transfer cylinder is positioned to be immersed in a pan of glue and it rotates toward the metering roller before it transfers the glue to the plate cylinder which actually applies the glue to the web of paper. In an alternate embodiment, a pan roller subassembly is provided which has a pan roller that extends into the pan of glue and applies the glue to the transfer cylinder, with the distance between the outer surfaces of the two cylinders being adjustable to provide the desired thickness of glue to the transfer cylinder, and then the transfer cylinder rotates toward the metering roller, which produces a more accurate thickness of glue that will be applied to the transfer cylinder.

It should be understood that with respect to the detailed description of the preferred and alternate embodiments to be described in connection with the attached drawings, that common reference numbers will be used where the identical or substantially similar component is present in the alternate embodiment, and the addition of the designation "a" will denote that a corresponding component is present in the alternate embodiment which may be of a slightly different shape or configuration.

Figure 2:
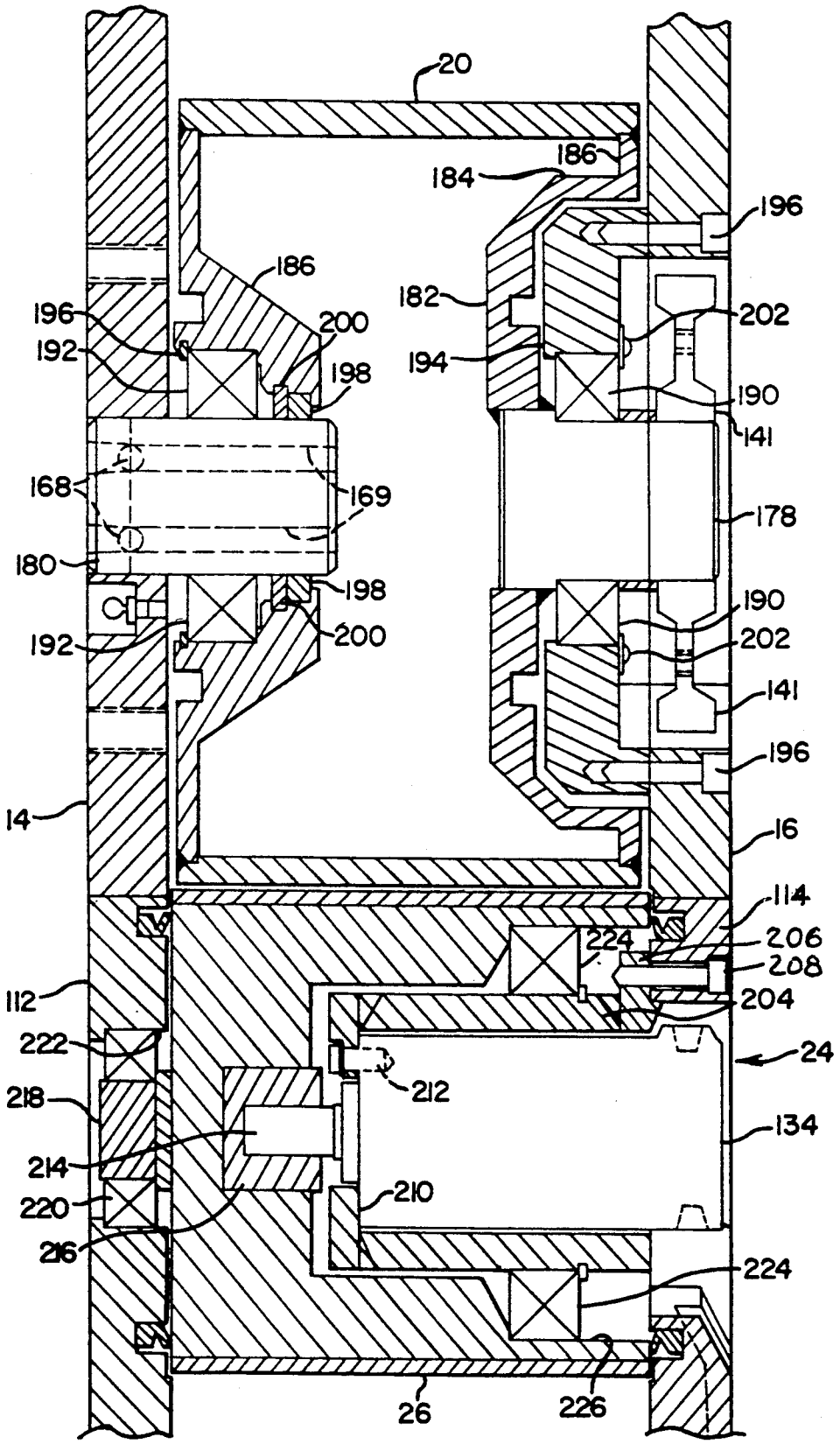
FIG. 2 is an end view of the embodiment illustrated in FIG. I, as well as the alternate embodiment illustrated in FIG. 3; and, FIG. 3 is a side elevation of a representative glue cell of an alternate embodiment of the present invention, and particularly illustrating an apparatus having an additional modular pan roller subassembly.

Turning now to the drawings, and particularly FIGS. 1 and 2, a representative glue cell 10 embodying the preferred embodiment is shown in side elevation and includes a transfer cylinder 12 that is rotatably mounted in side frames 14 and 16. As is shown in FIG. 2, the width of the transfer cylinder 12 is small, i.e., on the order of approximately six inches, although the width can be greater or lesser if desired. The transfer cylinder 12 is in position to transfer glue to a plate cylinder 18 which is a part of a gluing or coating machine and is not a component of the present invention. As shown in FIG. 1, the upper portion of the side frames 14, 16 has a circular portion 20 that is slightly larger than the outside diameter of the transfer cylinder and has an arcuate notch 22 in the immediate vicinity of the plate cylinder 18 so that there is adequate clearance between the side walls and the plate cylinder 18 when the transfer cylinder is in operating position.

A metering roller subassembly, indicated generally at 24, is provided, and comprises a modular unit that can be easily removed from the glue cell 10 as well as accurately positioned so that the outer surface of a metering roller 26 can cooperate with the outer surface of the transfer cylinder 12 to provide a precise thickness of glue to be carried by the transfer cylinder 12 to the plate cylinder 20.

The rotational direction of the various cylinders and rollers is as shown on the drawings. In this regard, the bidirectional arrow located on the metering roll means that it can be driven in either direction. When rotated in the clockwise direction as shown in FIG. 1, the metering roller operates in cooperation with the transfer cylinder in an extrusion manner of operation, whereas if the metering roller is rotated in the counterclockwise direction, it operates in a shear type of operation. In either type of operation, the result is a precise thickness layer of glue being carried by the transfer cylinder 12 to the plate cylinder 20. The direction of rotation of the metering roller is in part determined by the type of glue that is being applied. If operated in the counterclockwise direction, a preferably felt covered wiper 27 is provided.

To initially supply glue to the transfer cylinder 12 upstream in the direction of rotation thereof relative to the metering roller 26, a pan structure 28 is provided near the lower extent of the transfer cylinder 12 so that glue present in the pan structure 28 is picked up by the outer surface of the transfer cylinder 12. The pan structure has a bottom portion 30, left and right upturned end portions as illustrated, with the pan structure preferably extending fully between the side frames 14, 16 to contain the glue. Suitable gaskets (not shown, but conventional) are provided on both sides of the pan structure and cooperating with the side frames 14, 16 to provide adequate sealing function so that the glue will not leak out of the pan structure from the bottom portion thereof. An opening 36 is provided in the end 32 to enable glue to exit the pan structure, and the elevation of the opening is determined to provide the appropriate depth of glue in the pan structure. Another opening 38 is provided in an internal wall 40 at the other end 34 for admitting glue to the pan structure. The elevation of the opening 38 is preferably higher than the opening 36. The glue is preferably recirculated through the pan structure during operation.

To supply glue to the pan structure, a supply line 42 is provided from a pump 44 that is associated with a reservoir of glue 46, and the glue is pumped from this reservoir to all glue cells that may be provided for the gluing or coating machine. Additionally, it should be understood that there may be multiple reservoirs for supplying glue or other material to one or more of the glue cells. This may be desireable if two or more different materials may be applied by the same gluing or coating machine. As shown in FIG. the line 42 preferably comprises a rigid elongated nipple that extends through an opening in the bottom portion 30 so that it is sealed around the outer periphery of the nipple, and a flexible portion then extends back to the pump. To return the glue to the reservoir, a catch pan structure 48 is provided as merely comprises a plate that is angled downwardly toward the middle so that glue will drain in that direction, and a sump line 50 is attached to a nipple 52 or the like which is welded into an opening in the plate and extends back to the reservoir 46. While a gravity return may be provided, it is preferred that a suction return system be used, and to this end, a double headed pump 44 is provided in the line 50, and also in line 42. It should be understood that while a double headed pump 53 is preferred, for the simple reason that only one pump is therefore required, two pumps could be utilized. The pan structure 48 also preferably extends the full width between the side frames 14, 16 and suitable gaskets (also not shown, but conventional) are provided to seal the catch pan structure so that glue passes back to the reservoir. The pan structure is attached to the side frames 14, 16 by right angled brackets 54.

Turning now to the mounting structure for the glue cells, there is a left mounting subassembly 56 and a right mounting subassembly 58, each of which is attached to the side frames 14, 16 and to respective rails 60 and 62, which preferably extend across the full width of the web. The structural configuration of the respective mounting subassemblies 56, 58 are different in that the right subassembly is vertically adjustable, while the left subassembly is not. This permits the entire glue cell to be pivotable around the rail 60 to permit the transfer cylinder 12 to be brought into accurate operational proximity with the plate cylinder.

With respect to the left mounting subassembly 56, it cooperates with the rail 60 which is cylindrical and is suitably fixedly mounted to the gluing and/or coating machine. The subassembly 56 has a cross member 64 that is bolted to each of the side frames 14, 16 by bolts 66. A triangular brace member 68 is preferably welded to the cross member 64 and it is welded to a bottom support plate 70 that abuts another support plate 72 to which a bracket 74 is bolted by bolts 76. The two support plates 70 and 72 are bolted together by bolts 78. The bracket 74 has an opening for receiving the rail 60 in sliding and rotational engagement, to permit variable positioning along the rail 60 and rotational movement relative thereto. If the glue cell 10 is to be removed from the apparatus, the bolts 78 may be removed and the plates 70, 72 separated.

With respect to the right mounting subassembly 58, it has a cross member 80 that is attached to both side frames 14, 16 by bolts 82, and a hub portion 84 that is preferably welded to the cross member 80. The hub portion 84 has a threaded aperture 86, which receives an elongated threaded bolt 88 having a nut portion 90 at its upper end. The lower end of the bolt has a conical point 92 that is received by a cooperatively shaped conical recess 94 in a wear plate 96 that has a generally spherically curved lower surface as shown. The wear plate is retained by a housing 98 that is attached to a support plate 100 by bolts 102, and the support plate is bolted to another support plate 104 by bolts 106. A bracket 108 is also retained by the bolts 106 and the bracket rides on the rail 62, which also extends across substantially the full width of the web and which is attached to the gluing and/or coating machine. The bracket 108 is slidable along the rail 62 to permit variable positioning of the glue cell along the width of the web. To remove the glue cell, the bolts 106 can be removed, which will permit the plates 100 and 104 to be separated.

To adjust the elevation of the glue cell 10 relative to the rail 62, the bolt 88 can be rotated which will cause the bolt to extend or retract relative to the hub 84. When it is properly positioned, a set nut 110 can be tightened against the hub to lock the bolt 88 from rotation.

Referring again to the modular metering roller subassembly 24, it has side plates 112, 114 that are generally coplanar with the side plates 14, 16 and are of a shape as illustrated whereby there is a slight space between adjacent portions of the respective side plates, e.g., side plates 14 and 112, so that contact is prohibited. Each of the side plates 112, 114 have an arcuate notch 116 adjacent the area where the metering roller 24 is in closest proximity with the transfer cylinder 12 to provide clearance.

The metering roller subassembly 24 is easily installed and/or removed as well as positioned relative to the transfer cylinder 12, by a three component mounting design. Each of the side plates 112, 114 has a half thickness area 118 (at the bottom left of the side plate 112) which is in proximity to a similar half thickness portion 120 of the side frames 14, 16. Also, each of the half thickness portions of the side frames 14, 16 and side plates 112, 114 have a circular aperture 121 through which a close tolerance mounting slug 122 may snugly fit. The mounting slug permits rotation of the subassembly 24 so that the metering roller 26 may be moved relative to the transfer cylinder to obtain the correct thickness of glue to remain on the transfer cylinder 12 for application to the plate cylinder 20.

Each side of the plates 112 and 114 have a flange 126 extending outwardly and each flange has a threaded aperture in which a threaded bolt 128 is inserted and the lower portion of the bolt bears against the side frame 14. This enables the metering roller 26 to be moved relative to the transfer cylinder 12. Removal of the subassembly 24 merely requires removal of the mounting slugs 122, disconnecting hydraulic lines, and it can then be lifted from the glue cell 10 by a handle 130 that is attached to both side plates 112, 114 by bolts 132.

To drive the metering roller 26, a small hydraulic motor 134 is provided and hydraulic lines 136, 138 are provided and preferably have quick-connect connectors 139 for connection to hydraulic lines that extend to a source of hydraulic fluid. The motors are located within the metering roller 26 itself, which contributes to the compact design of the subassembly. The motors are preferably Series M, low speed, high torque hydraulic motors, which are side ported, as manufactured by the Hydraulics Division of Eaton Corporation of Eden Prairie, Minn. 55344.

Figure 3:
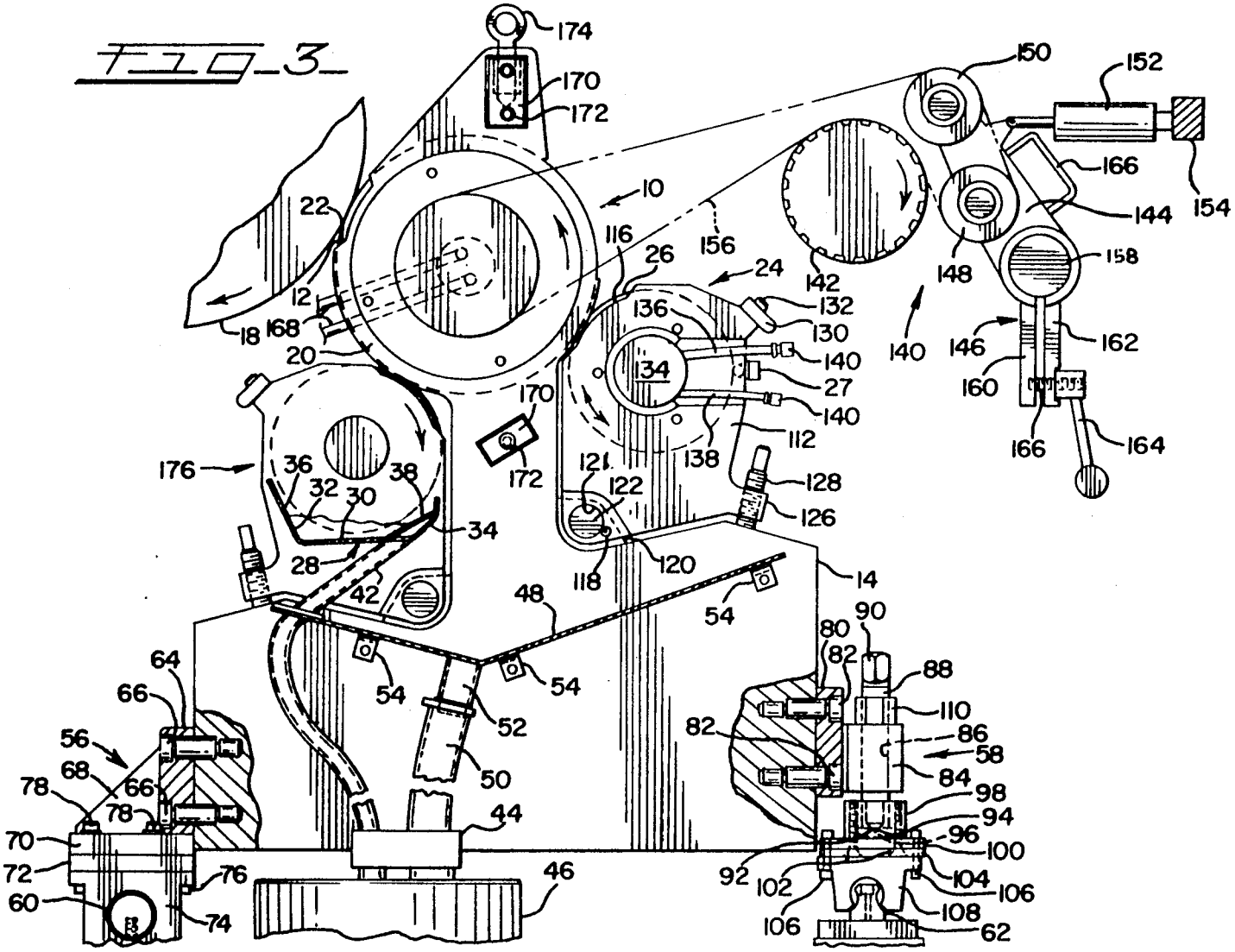

To drive the transfer cylinder 12, a drive mechanism, indicated generally at 140, is provided that is connected to the drive train of the gluing and/or coating machine itself is preferred, so that the transfer cylinder will be rotated at a speed comparable to the speed of the press, and particularly the speed of the plate cylinder 20. The drive mechanism 140 includes a timing belt drive sprocket 141 attached to the transfer cylinder in a manner to be described, a continuous sprocket drive shaft 142 having sprocket teeth extending substantially the full width of the web, a support bracket 144 having a clamp mechanism 146, a pulley 148 attached to the bracket 144, a tensioning pulley 150, a cylinder 152 attached to a fixed cross member 154 with the cylinder having an extendable and retractable piston attached to the bracket 144, and a double sided timing belt 156. The use of the double sided timing belt 156 in the configuration shown in FIGS. 1 and 3 is such that the belt 156 is not trapped by the drive shaft 142. This permits the drive mechanism 140 and the timing belt 156 to be easily moved and even removed without any necessity to remove the drive shaft 142.

A tubular shaft 158 is provided across the entire width of the web and provides a mounting support for the drive mechanism. The clamp mechanism 146 has a circular inside surface of split design, with extensions 160, 162 that are moved relative to one another by a rotatable handle 164 attached to a threaded bolt 166 that engages a threaded aperture in the extension 160 for tightening the bracket 144 relative to the shaft 158. The timing belt travels around the transfer cylinder pulley, the drive shaft 142 and pulleys 148 and 150, with the cylinder 152 providing the desired tension in the pulley before the clamp handle 164 is tightened. Another handle 166 may be provided and is attached to the bracket 144 to enable an individual to position the bracket along the width of the web.

For each glue cell 10, there will be a bracket 144 with attached components, and the bracket can be moved along the tubular shaft 158 so as to align the drive mechanism with the glue cell 10. The continuous sprocket drive shaft 142 also extends substantially across the full width of the web so that it can engage the timing belt to drive the transfer cylinder. The drive shaft 142 is connected with conventional hardware to the drive train of the gluing and/or coating machine, and will therefore drive the transfer cylinder at the same speed as the press during operation.

Since it may be desireable to cool the transfer cylinder, cooling lines may be extended from a source of cooled liquid to the transfer cylinder. To aid in the compact design, ports 168 may be drilled in one of the side frames 14, which are then communicated to transverse ports 169 which communicate to the interior of the transfer cylinder as shown in FIG. 2.

The side frames 14, 16 are precisely spaced and fixed relative to each other by spacer blocks 170 that are bolted to both side frames by bolts 172. An eye bolt 174 is also preferably attached to the upper spacer block 170 to facilitate lifting the glue cell during installation or removal.

In accordance with another important aspect of the present invention, and referring to FIG. 2, the transfer cylinder 20 has a short live axle journal 178 and a dead axle journal 180 that are employed to mount the cylinder in the apparatus. The side frame 16 has a recess in which the drive sprocket 141 is located and the drive sprocket 141 is mounted to the journal 178 as shown. The journal 178 is attached, preferably by welding or the like, to a transfer cylinder side wall 182 which has a right angled extension 184, which in turn has a radially directed portion 186 which attached to the outer cylindrical surface of the transfer cylinder. The transfer cylinder 20 also has another side wall 186 that has an enlarged hub portion as illustrated. The transfer cylinder is rotatable on two bearings 190, 192. A cylindrical mounting plate 194 is provided and is bolted to side frame 16 by bolts 196 and it has a cylindrical opening adapted to receive the outer race of the bearing 190, the inner race of which fits on the journal 178. The transfer cylinder 20, journal 178 and drive sprocket 141 are thereby rotatable relative to the mounting plate 194 and side frame 16. With respect to the bearing 192, the outer race thereof fits within a circular opening within the transfer cylinder side wall 186 and the inner race fits over the cylinder 180. An annular retaining clip 196 retains the bearing 192 from movement to the left as shown in FIG. 2. Since the interior of the transfer cylinder is cooled by circulating fluid therethrough, the volume between the side walls 182, 186 and outer surface is filled with fluid. To keep the fluid from reaching the bearing 192, a pair of annular seals 198, 200 are provided and they fit within appropriately sized annular grooves and bear against the journal 180. The bearing 190 is retained from moving to the right as shown in FIG. 2 by a series of washers held by screws as illustrated at 202.

In accordance with yet another important aspect of the present invention, the internal construction of the metering roller subassembly is illustrated in FIG. 2 and it has the hydraulic motor 134 retained essentially within the interior of the metering roller 26. The motor 134 is cylindrically shaped and fits within a cylindrical mounting member 204 that has an outward extension 206 that has threaded apertures for receiving bolts 208 for mounting the same to the side wall 116. A circular annular plate 210 is secured to the mounting member 204 by bolts (not shown) and other bolts 212 attach the motor to the annular end plate 210. The motor 134 has an output shaft 214 that is secured to a cylindrical member 216 that is keyed to the metering roller 26. The roller 26 has a smaller cylindrical shaft portion 218 over which the inner race of a bearing 220 is placed and the outer race is retained in a circular aperture 222 in the side wall 112. A significantly larger bearing 224 is provided on the other end portion of the metering roller and its inner race fits on the mounting member 204 and the outer race is contained within an inner surface 226 of the metering roller 26 that is near the outer surface of the roller 26. With such arrangement, the motor is adapted to drive the metering roller and the position of the two bearings results in smooth, stable, nonwobbling rotation thereof.

In the alternate embodiment shown in FIG. 3 an additional modular pan roller subassembly is provided, and is indicated generally at 176. The pan roller subassembly 176 applies glue from the pan structure 28 to the transfer cylinder surface, rather than have the transfer cylinder extend into the glue in the pan. The addition of the pan roller subassembly provides some advantage in the maintenance of close tolerances for the thickness of the glue that is applied, but such addition also carries an attendant increase in cost. When the pan roller subassembly is provided, the pan structure 28 is installed in proximity with the pan roller subassembly, rather than the transfer cylinder, as is evident. The construction of the pan roller subassembly is virtually identical with the metering roller subassembly, and for that reason carries the identical reference numbers from FIG. 1. It should be understood that while the subassemblies are identical, the view of the pan roller subassembly shown in FIG. 3 is the mirror image of the view of the metering roller subassembly shown in FIG. 1.

From the foregoing, it should be understood that a dramatically improved apparatus for applying glue to a cylinder of a gluing and/or coating machine has been shown and described, which offer many significant and desireable advantages over many prior art apparatus. The extreme flexibility of installing one or more individual glue cells permits glue to be applied in many locations across the width of the web, and if a failure occurs with respect any one of the glue cells, it can be easily removed and repaired with a minimum of downtime, particularly if a spare glue cell is available. Moreover, the modular design of the components of the glue cell itself also greatly contributes to the ease of maintenance and repair.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for applying a layer of predetermined thickness of liquid such as glue or the like to a printing cylinder of a web gluing and/or coating machine or the like, wherein the layer is of a width less than the width of the cylinder, the web gluing and/or coating machine having a drive train for driving the components of the gluing and/or coating machine, comprising:

at least one modular glue cell, each glue cell, each glue cell including side frames and a transfer cylinder rotatably journaled between the side frames, said transfer cylinder having an outer surface adapted to receive glue and apply the same to the gluing and/or coating machine printing cylinder;

a metering subassembly mounted to each such glue cell and including a metering roller having an outer surface, the subassembly being adjustable to adjust the outer surface of the metering roller relative to the outer surface of said transfer cylinder to regulate the thickness of the glue to be applied to the gluing and/or coating machine printing cylinder;

means for mounting the glue cell comprising support means extending substantially the full width of the web and glue cell mounting means connected to the glue cell, the glue cell mounting mean s being adjustably positionable along the support means and adjustable to vary the position of the transfer cylinder relative to the gluing and/or coating machine printing cylinder;

drive means for interconnecting the gluing and/or coating machine drive train and the transfer cylinder so that the transfer cylinder is driven at the same speed as the gluing and/or coating machine; and, means for supplying glue to the outer surface of said transfer cylinder.

2. Apparatus as defined in claim 1 wherein said support means comprises a pair of spaced rails, each of which extends across the width of the web sufficient to enable one or more glue cells to be positioned to apply liquid to one or more selected areas substantially across the entire width of the web.

3. Apparatus as defined in claim 2 wherein said support means comprises first and second mounting means that are cooperatively connected to first and second ones of said rails, said first mounting means being pivotable about said first rail, and said second mounting means being adjustable vertically relative to said second rail to thereby vary the position of the transfer cylinder relative to the gluing and/or coating machine printing cylinder.

4. Apparatus as defined in claim 3 wherein said first rail has a circular cross section and said first mounting means has a circular aperture adapted to receive said first rail and be slidable along the length of said first rail and be pivotable relative thereto.

5. Apparatus as defined in claim 3 wherein said second mounting means comprises first and second mounting members, the first mounting member being connected to a respective said glue cell and the second mounting member being cooperatively connected to said second rail, said second mounting means including bolt means interconnecting said first and second mounting members and being rotatable to vary the vertical distance between said first and second mounting members.

6. Apparatus as defined in claim 5 wherein said first mounting member is removable from said respective glue cell and said second mounting member is removable from said second rail, thereby enabling each of said glue cells to be lifted and removed from the gluing and/or coating machine on which it is installed.

7. Apparatus as defined in claim 1 wherein each of said glue cells has a relatively narrow width.

8. Apparatus as defined in claim 7 wherein each of said glue cells has a width within the range of about two inches to about four inches.

9. Apparatus as defined in claim 1 further including a pan structure mounted between the side frames of each glue cell adapted to receive liquid that may drain from said transfer cylinder and/or metering roller, said pan structure having a drain means for draining liquid received therein back to a reservoir of liquid, said pan structure being positioned beneath said transfer cylinder and said metering roller.

10. Apparatus as defined in claim 9 wherein said pan structure includes sealing means located between the pan structure and each of said side frames for preventing leakage of liquid therebetween.

11. Apparatus as defined in claim 1 wherein said metering subassembly includes subassembly side frames for journaling said metering roller, said metering subassembly including a motor means for driving said metering roller, said motor means being mounted inside of said metering roller and substantially between said subassembly side frames.

12. Apparatus as defined in claim 11 wherein said motor means comprises a generally cylindrically shaped hydraulic motor having an output shaft at one end thereof, the length of the motor including said shaft being less than the length of the metering roller, said shaft being connected to the metering roller to enable the motor to drive the metering roller.

13. Apparatus as defined in claim 12 wherein said metering subassembly includes a motor mounting means that comprises a cylindrically shaped member adapted to receive and be connected to the motor, said member having one end attached to one subassembly side frame, the outer diameter of the cylindrically shaped member being less than the inside diameter of the metering roller to permit rotation of the same relative to the cylindrically shaped member.

14. Apparatus as defined in claim 13 wherein said motor mounting means includes a circular plate attached to the end of said cylindrically shaped member opposite the end that is attached to said one subassembly side frame, said circular plate having an opening through which said motor output shaft extends, said motor being attached to said circular plate.

15. Apparatus as defined in claim 13 wherein said metering roller is journaled for rotation in first and second ball bearing means respectively located at opposite end portions of said metering roller, each ball bearing means having inner and outer races, said first ball bearing means having its outer race retained in one of said subassembly side walls and its inner race fitting over a reduced diameter extension of said metering roller, said second ball bearing means having its inner race fitting over the outside of said cylindrically shaped member and its outer race retained in an inside surface of said metering roller.

16. Apparatus as defined in claim 11 wherein the side frames of each glue cell have a base portion with a generally horizontal upper surface and a vertical portion having a generally vertical first surface, the side frames being cut out in the vicinity of a respective said metering subassembly and adapted to receive said respective metering subassembly, the side frames of each glue cell and said respective metering subassembly being generally coplanar, a respective metering subassembly being pivotally connected to each glue cell generally at the junction of each glue cell upper surface and said vertical first surface, each metering subassembly having adjusting means for moving a respective said metering subassembly relative to said horizontal upper surface.

17. Apparatus as defined in claim 16 including a removable cylindrical means for interconnect said metering subassembly side frames and respective said glue cell side frames.

18. Apparatus as defined in claim 17 wherein each of said metering subassembly side frames have 3 an extension at the end opposite said pivot junction, said adjusting means comprising two threaded bolt means, one of which fits within a threaded aperture within each of said extensions and which moves each metering subassembly relative to respective said glue cell side frames.

19. Apparatus as defined in claim 1 further including a liquid pan structure attached to said side frames of each glue cell and being adapted to hold a supply of liquid in proximity to said transfer cylinder whereby the outer surface of said transfer cylinder is partially immersed into the liquid to coat the same.

20. Apparatus as defined in claim 1 including a pan subassembly having a pan roller, said pan subassembly including subassembly side frames for journaling said pan roller, said pan subassembly including a motor means for driving said pan roller, said motor means being mounted inside of said pan roller and substantially between said subassembly side frames.

21. Apparatus as defined in claim 20 wherein said motor means comprises a generally cylindrically shaped hydraulic motor having an output shaft at one end thereof, the length of the motor including said shaft being less than the length of the pan roller, said shaft being connected to the pan roller to enable the motor to drive the pan roller.

22. Apparatus as defined in claim 21 wherein said pan subassembly includes a motor mounting means that comprises a cylindrically shaped member adapted to receive and be connected to the motor, said member having one end attached to one subassembly side frame, the outer diameter of the cylindrically shaped member being less than the inside diameter of the pan roller to permit rotation of the same relative to the cylindrically shaped member.

23. Apparatus as defined in claim 22 wherein said motor mounting means includes a circular plate attached to the end of said cylindrically shaped member opposite the end that is attached to said one subassembly side frame, said circular plate having an opening through which said motor output shaft extends, said motor being attached to said circular plate.

24. Apparatus as defined in claim 22 wherein said pan roller is journaled for rotation in first and second ball bearing means respectively located at opposite end portions of said pan roller, each ball bearing means having inner and outer races, said first ball bearing means having its outer race retained in one of said subassembly side walls and its inner, race fitting over a reduced diameter extension of said pan roller, said second ball bearing means having its inner race fitting over the outside of said cylindrically shaped member and its outer race retained in an inside surface of said pan roller.

25. Apparatus as defined in claim 20 wherein each glue cell includes a said pan subassembly, the side frames of each glue cell have a base portion with a generally horizontal upper surface and a vertical portion having a generally vertical first surface, the side frames being cut out in the vicinity of a respective said pan subassembly and adapted to receive said respective pan subassembly, the side frames of each glue cell and respective said pan subassembly being generally coplanar, each pan subassembly being pivotally connected to a respective said glue cell generally at the junction of said glue cell upper surface and said vertical first surface, each pan subassembly having adjusting means for moving a respective said pan subassembly relative to said horizontal upper surface.

26. Apparatus as defined in claim 25 including a removable cylindrical means for interconnecting said pan subassembly side frames and respective said glue cell side frames.

27. Apparatus as defined in claim 26 wherein each of said pan subassembly side frames have an extension at the end opposite said pivot junction, said adjusting means comprising two threaded bolt means, each of which fits within a threaded aperture within each of said extensions and which moves each pan subassembly relative to respective said glue cell side frames.

28. Apparatus as defined in claim 20 further including a glue pan structure attached to said pan subassembly side frames and being adapted to hold a supply of liquid in proximity to said pan roller whereby the outer surface of said pan roller is partially immersed into the liquid to coat the same.

29. Apparatus as defined in claim including a transfer cylinder drive sprocket attached to one end portion of said transfer cylinder, one of said side frames having a recess located therein adjacent said transfer cylinder adapted to permit a drive belt to be attached to said transfer cylinder drive sprocket.

30. Apparatus as defined in claim 29 wherein said transfer cylinder includes two axially aligned shaft segments located at each end thereof, bearing means associated with said transfer cylinder and each shaft segment adapted to permit rotation of said transfer cylinder.

31. Apparatus as defined in claim 30 wherein said transfer cylinder has a hollow interior defining a reservoir in which liquid is circulated for cooling said transfer cylinder, one of said shaft segments including input and output ports through which liquid can be respectively inserted and removed.

32. Apparatus as defined in claim 31 wherein said one of said shaft segments is nonrotatable and the other of which is rotatable.

33. Apparatus as defined in claim 32 including a generally cylindrical support member attached to one of said side frames and supporting one of said bearing means, said other shaft segment being attached to said transfer cylinder drive sprocket and to said transfer cylinder.

34. Apparatus as defined in claim 31 wherein said one side frame includes input and output ports communicating with said respective input and output ports of said one shaft segment, said side frame input and output ports being adapted to be connected to lines extending to a source of cooling liquid.

35. Apparatus as defined in claim 29 wherein said drive means includes an elongated drive cylinder having sprocket teeth extending substantially the full width of the web, a double sided timing belt which engages the sprocket teeth and said transfer cylinder drive sprocket, and means for tensioning the timing belt, said tensioning means being adjustably positioned along the width of the web, the double sided timing belt being positioned in said drive means whereby it is not trapped by said elongated drive cylinder.

36. Apparatus as defined in claim 35 wherein said tensioning means includes a stationary support extending substantially across the full width of the web, a bracket means moveable along the length of said stationary support, said bracket means carrying a rotatable idler roller, and a tensioning roller that is adjustable relative to said drive cylinder and said idler roller, said timing belt being moveable around said idler roller and said tensioning roller, said tensioning means including means for biasing said tensioning roller to properly tension said timing belt.

37. Apparatus as defined in claim 19 wherein said liquid supplying means comprises pump means, a flexible supply conduit and a supply of liquid, said pump means being adapted to pump liquid from said liquid supply through said supply conduit to said liquid pan structure.

38. A drive subassembly adapted for mounting to an apparatus associated with a web gluing and/or coating machine, which is of the type which has a rotatable cylinder having an outer surface, said subassembly including a first roller having an outer cylindrical surface, the subassembly being adjustable to adjust the outer surface of the first roller relative to the outer surface of the cylinder associated with the apparatus to regulate the distance between the first roller and the cylinder, said subassembly including subassembly side frames for journaling said first roller, said subassembly including a motor means for driving said first roller, said motor means being mounted inside of said first roller and substantially between said subassembly side frames.

39. A drive subassembly as defined in claim 38 wherein said motor means comprises a generally cylindrically shaped hydraulic motor having an output shaft at one end thereof, the length of the motor including said shaft being less than the length of the first roller, said shaft being connected to the first roller to enable the motor to drive the first roller.

40. A drive subassembly as defined in claim 39 further including a motor mounting means that comprises a cylindrically shaped member adapted to receive and be connected to the motor, said member having one end attached to one subassembly side frame, the outer diameter of the cylindrically shaped member being less than the inside diameter of said first roller to permit rotation of the same relative to the cylindrically shaped member.

41. A drive subassembly as defined in claim 40 wherein said motor mounting means includes a circular plate attached to the end of said cylindrically shaped member opposite the end that is attached to said one subassembly side frame, said circular plate having an opening through which said motor output shaft extends, said motor being attached to said circular plate.

42. A drive subassembly as defined in claim 40 wherein said first roller is journaled for rotation in first and second ball bearing means respectively located at opposite end portions of said first roller, each ball bearing means having inner and outer races, said first ball bearing means having its outer race retained in one of said subassembly side walls and its inner race fitting over a reduced diameter extension of said first roller, said second ball bearing means having its inner race fitting over the outside of said cylindrically shaped member and its outer race retained in an inside surface of said first roller.

* * * * *

UNITED STATES PATENT AND TRADEMARK OFFICE

CERTIFICATE OF CORRECTION

PATENT NO. : 5,101,757

DATED : April 7, 1992

INVENTOR(S) : Thomas H. Schumacher

It is certified that error appears in the above-identified patent and that said Letters Patent is hereby corrected as shown below:

Column 2, line 54, change "I" to --1--.

Column 5, line 4, after "FIG." insert --1,--.

Column 9, line 24, delete "or the like".

Column 9, lines 25-26, delete "or the like".

Column 9, line 30, delete "each glue cell,".

Column 9, line 34, change "glue" to --liquid--.

Column 9, line 41, change "glue" to --liquid--.

Column 9, line 43, change "the" to --each--.

Column 9, line 46, change "the", both occurrences, to --each--.

Column 9, line 46, change "mean s" to --means--.

Column 9, line 56, change "glue" to --liquid--.

Column 11, line 33, change "interconnect" to --interconnecting--.

Column 11, line 37, delete "3".

Column 12, line 17, delete ",".

UNITED STATES PATENT AND TRADEMARK OFFICE
CERTIFICATE OF CORRECTION

PATENT NO. : 5,101,757

DATED : April 7, 1992

INVENTOR(S) : Thomas H. Schumacher

It is certified that error appears in the above-identified patent and that said Letters Patent is hereby corrected as shown below:

Column 12, line 55, after "claim" insert --1--.

Signed and Sealed this

Sixth Day of July, 1993

*Attest:*

*Attesting Officer*

Michael K. Kirk

MICHAEL K. KIRK

*Acting Commissioner of Patents and Trademarks*